United States Patent [19]

Sakamoto et al.

[11] 4,217,762

[45] Aug. 19, 1980

[54] ICE MAKING EQUIPMENT

[75] Inventors: Shigeru Sakamoto, Tokyo; Hiroyuki Moriyama, Mitaka; Ryosuke Fujii, Higashimurayama; Toshiharu Ishii, Yokohama; Isao Sugawara, Urawa; Minoru Kikuchi, Chiba, all of Japan

[73] Assignee: Taisei Corporation, Tokyo, Japan

[21] Appl. No.: 5,971

[22] Filed: Jan. 24, 1979

[30] Foreign Application Priority Data

Sep. 8, 1978 [JP] Japan ..... 53-110316

[51] Int. Cl.[2] ..... F25C 1/18

[52] U.S. Cl. ..... 62/132; 62/356; 62/70

[58] Field of Search ..... 62/340, 356, 70, 132

[56] References Cited

U.S. PATENT DOCUMENTS

| | | | |
|---|---|---|---|
| 990,590 | 4/1911 | Ray | 62/356 |
| 1,680,381 | 8/1928 | Jennings | 62/356 X |
| 1,783,808 | 12/1930 | Martocello | 62/70 |
| 1,817,263 | 8/1931 | Morse | 62/356 X |
| 1,854,343 | 4/1932 | Martocello | 62/70 |
| 1,925,616 | 9/1933 | Velut | 62/356 X |
| 2,506,614 | 5/1950 | Ribeiro | 62/70 |
| 2,528,795 | 11/1950 | Shontz | 62/356 X |
| 3,274,794 | 9/1966 | Wilbushewich | 62/356 X |

*Primary Examiner*—Albert J. Makay
*Assistant Examiner*—William E. Tapolcai, Jr.
*Attorney, Agent, or Firm*—Irving M. Weiner; Pamela S. Burt; Melvin Yedlin

[57] ABSTRACT

The steps of handling ice cans in an ice making plant, such as placing the ice cans in alignment within one or more ice tanks, transferring ice cans each containing formed ice block to a stripping-off area, and placing and separating of the cover lid relative to ice can units, are automatically performed by an overhead travelling crane.

Particularly, several ice can units are placed in the ice tank such that pairs of lugs provided on each ice can unit are arrayed in two straight lines to enable the overhead crane to selectively lift the ice cans.

In order to produce high-quality ice blocks which are completely transparent through to the core portion thereof, each ice can is correlated with means for agitating ice making water contained therein and is connected with a piping for exchanging core water, in which impurities or foreign particles are likely to gather, with fresh water.

The stripping-off of the ice blocks from the ice cans is also performed by an automatic system.

25 Claims, 18 Drawing Figures

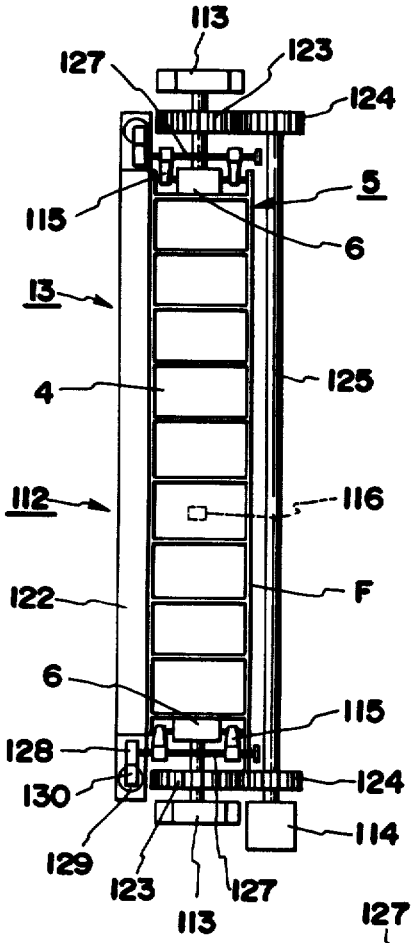
FIG. 12
FIG. 13
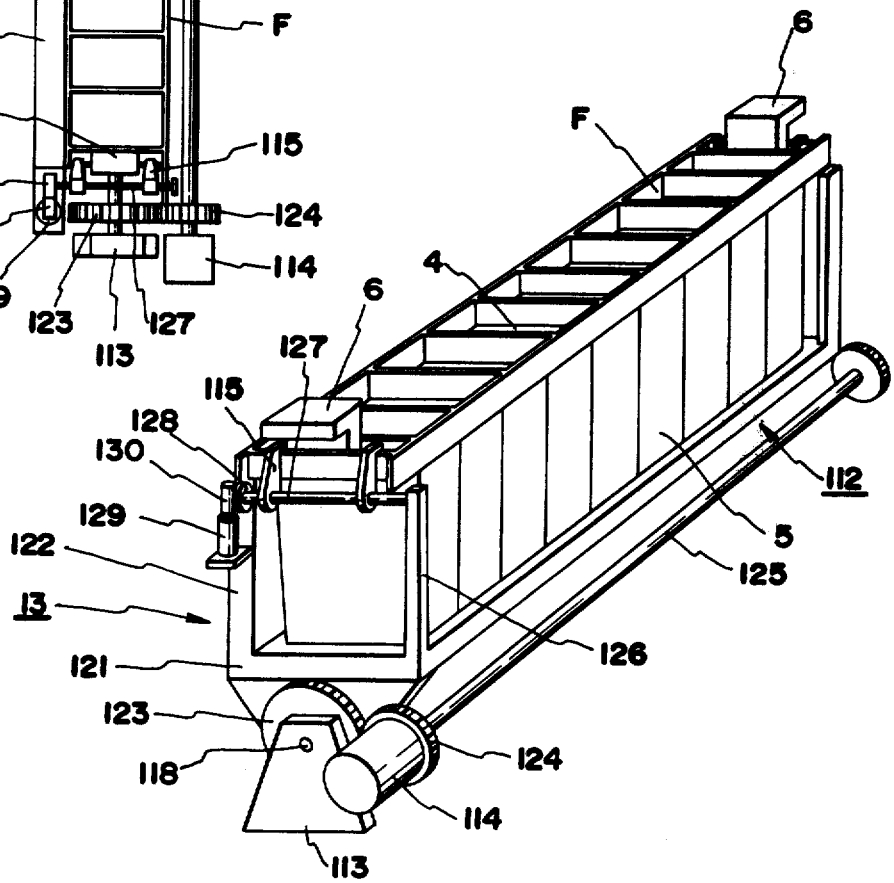

ICE MAKING EQUIPMENT

BACKGROUND OF THE INVENTION

1. Field of the Invention

The present invention relates to ice making equipment, and more particularly to highly mechanized and automatically controllable equipment wherein ice cans, each filled with ice block, are selectively lifted and transferred by an overhead travelling crane to a stripping-off area, where each ice block is stripped off from a respective ice can.

Further, the present invention generally improves the process of ice making by providing automatic process control, such as agitation of water fed into the ice cans, to ensure high quality of the ice blocks. The ice blocks formed in accordance with the present invention have uniform density and are entirely transparent, even through to the core portion of each of the ice blocks.

2. Description of the Prior Art

In conventional ice making plants, overhead travelling cranes have been employed, however, the engagement and disengagement of a lifting hook with a pair of lugs on the ice can has been manually made by one or more workers. Further, after the hook of the overhead travelling crane has been engaged with the lugs of the ice can or can unit, additional operations have conventionally been manually performed by one or more workers who move along following the travel of the crane.

The above-described disadvantages and inconveniences are attributable to the fact that the engagement and disengagement of the hook with the lugs of the can or ice can unit, as well as lifting and closing of the lid on the ice cans, had to be manually performed by the workers.

Although conventionally a plurality of ice cans are grouped to form ice can units, there has remained undesirable spaces between the cans where the lugs are provided. Therefore, the pitch of the array of ice cans has become non-uniform at such places, where excessive amounts of freezing brine flows, resulting in non-uniformity between the array of ice cans and naturally giving rise to variations in the quality of the produced ice blocks.

Moreover, some ice blocks formed by the prior art system have inevitably been found to be poor in transparency due to smoky white core portions. Such ice blocks are also non-uniform with respect to both density and hardness and cannot be given a high-grade rating.

According to the prior art method, agitation of the water in each ice can has been performed by blowing air into water to obtain ice blocks of good quality. To this end, branch pipes and sub-branch pipes are carried to a main pipe which is connected to the exhaust port of an air compressor installed in the plant. In order to obtain transparent ice blocks, it has been necessary to carry and connect such branch pipes and sub-branch pipes to the main pipe concurrently with dipping of the ice cans filled with brine into one or more ice making tanks. However, such concurrent steps require a large amount of manpower. Moreover, manual carrying and connecting of the heavy branch pipes is considerably heavy labor for the workers, and minimizing such heavy labor as well as reducing required manpower has long been desired.

The sub-branch pipes must be taken up as the amount of ice in the ice can increases in order to prevent the pipes from being caught and held fixed by the frozen ice blocks, and such work also has conventionally been performed manually by one or more workers. It has also been desired to improve this manual operation from the viewpoint of the worker's health.

Another problem attendant the conventional method is that during the course of formation of ice in each ice can, water called "core water" gathers towards the core portion of the ice can due to the fact that water solidifies into ice from the inner periphery of the ice can toward its center. Any impurities or foreign matter in the water are likely to accumulate in this "core water."

Accordingly, it has also been found necessary to exchange the core water with fresh water in order that wholesome ice blocks are formed, and such exchanging of the core water has also been manually performed, and has been a serious problem in an ice making plant where a large number of ice cans are used and handled.

In order to provide automation and improvement of working conditions in an ice making plant, the problems encountered in exchanging the core water must necessarily be solved.

The present inventors have completed a series of related inventions in view of the various problems encountered in ice making plants and have filed a number of patent applications in Japan.

Such Japanese applications comprise:

Japanese Laid-Open (Unexamined) Utility Model Publication No. 116060/78; and

Japanese Laid-Open (Unexamined) Patent Publication Nos. 53053/78, 40410/78, 36059/78, 36060/78 and 24159/78.

The present invention solves the problems and shortcomings attendant the conventional ice making techniques.

SUMMARY OF THE INVENTION

The present invention provides ice making equipment including a plurality of ice cans each provided with lugs for lifting the ice cans, the ice cans being placed in alignment within at least one ice tank in such a manner that the lugs are aligned with regular spaces therebetween. The ice tank(s) are disposed in an ice making area. A plurality of branch pipes and sub-branch pipes are mounted on the ice cans, the pipes being adapted to be connected to an air supply source. Means are provided for supplying and treating ice making water, the pipes being adapted to be connected to the supplying and treating means. The branch pipes are connected to the sub-branch pipes so as to hoist up and lower down the sub-branch pipes. A plurality of cover lids are provided for covering the ice cans, and an ice stripping-off area is also provided, with means for stripping-off ice blocks formed within the ice cans. A pair of rails extends between the ice making area and the ice stripping-off area. Further provided is at least one overhead travelling crane adapted to lift, transfer, and unload the ice cans with the cover lid placed thereon or with the cover lid separated therefrom. The crane includes at least one movable trolley adapted to travel on the pair of rails, guide rods suspended from the trolley, and a hook device adapted to be raised or lowered while being guided by the guide rods, the hook device being adapted to selectively engage with and support thereon the lugs for lifting the ice cans.

An object of the present invention is to provide ice making equipment which is adapted to be used in an ice making plant, the equipment being operable by an automatic control system.

Another object of the present invention is to provide ice making equipment capable of making a large number of ice blocks.

A further object of the invention is to reduce the heavy load imposed on the workers in an ice making plant, and to improve working conditions in such a plant.

Another object of the present invention is to provide ice making equipment capable of making high quality and wholesome ice blocks in large numbers, which blocks are transparent through to the core portion thereof.

Another object of the present invention is to automate a series of steps in ice making such as placing of the ice cans or can units, selective lifting of such ice cans or can units, transferring to the stripping-off area, handling of cover lids, and stripping-off of the ice blocks.

A further object of the invention is to provide automatic ice making equipment capable of performing operations such as supplying water to each ice can, and connecting and disconnecting the pipe lines for exchanging the core water.

A still further object of the present invention is to provide supply air piping and piping for exchanging core water, which piping can be hoisted automatically and in only one direction.

According to the present invention, ice cans, or can units including a plurality of ice cans, are arranged in an ice making tank in a straight array so that lugs provided on the ice cans or on the can units can be arranged in a regular array. In this manner, the lugs on the can units can be selectively engaged with and picked up by a mere linear movement of the hook means of an overhead crane.

With the present invention, hoisting, lowering and lateral movement of the overhead travelling crane is operable by a previously-programmed automatic control means to selectively lift the can unit including its cover lid, as well as to open and close the cover lid with respect to the can unit. In other words, the cover lid placed on the ice cans or can unit can be released away from the ice cans or can unit by pawls or chucks. Pawls are provided at the lower part of a pair of guide rods and protrude toward and extend over the lower rim of the cover lid such that only the cover lid is held by the guide rod while the ice cans or can units are lowered by a hook device of the overhead crane. Accordingly, because the pawls do not protrude and extend over the lower rim of the cover lid, raising or lowering of the hook device can be made while still holding the cover lid being placed on the can unit.

In the ice stripping-off area according to the invention, there is provided equipment which receives the ice cans or can units, holds them, and takes off the ice blocks by tilting them and allowing the ice blocks to be dispensed from each ice can. This equipment is operable by a control means in accordance with a programmed control correlated with the movement of the overhead travelling crane. Opening and closing of the cover lid by using the crane is also primarily carried out in such taking-off area.

The cover lid for the ice cans or can unit carries a branch pipe and a plurality of sub-branch pipes thereon. Accordingly, the branch pipe must be made selectively attachable as well as detachable to both a supply air main pipe and piping for exchange of core water during the ice making step. For these reasons, the branch pipe is arranged to be connected with the main pipe or water piping by a suitable joint means at a place outside the area where the ice cans or can units are placed or moved, so as to avoid disturbance by the other member.

According to the present invention, the branch pipe is connected to the main pipe when the ice cans or can unit is placed in a desired position of the ice making tank. The main pipe is provided with a stop valve. The pipe line for exchanging the core water which comprises a necessary number of pumps and filter means, is branched by means of an exclusively-arranged stop valve between the stop valve in the main pipe and the specially arranged stop valve. The branch pipe is journally supported above the ice cans or can unit, i.e., on the cover lid, so as to be rotated about its axis. By virtue of this construction, the branch pipe also acts as a shaft to hoist up the sub-branch pipe. For this purpose, a swivel joint is provided at a place slightly before the connection between the branch pipe and the joint device.

According to the present invention, another manner of agitating the material in each ice can other than the conventional air supply type may be employed. An agitating plate or tag is suspended in each ice can from a branch shaft which is journally supported by one or more bearings mounted on or beneath the cover lid. The branch shaft is bent downwardly normal to its axis at a location away from the cover lid and engages with a link moving reciprocally in an almost horizontal direction. Therefore, the branch shaft is rotated about its axis at a suitable angle and in two directions, normal and reverse, thus causing the agitating plate to make a swinging motion. This agitating plate is arranged so as to be heated by electrical resistance heating which enables ready removal of the agitating plate from the ice block in the ice can.

As mentioned hereinabove, substantially all the steps involved in ice making, from the ice block making to the stripping-off of ice blocks, can be highly automated in accordance with the present invention. Accordingly, the problems relating to the workers' health are completely solved. The invention further provides a remarkable increase in productivity, and the ice blocks produced are transparent through to the core portion, and are very wholesome.

BRIEF DESCRIPTION OF THE DRAWINGS

FIG. 12 is a plan view of a device for stripping-off ice blocks from the ice can units.

FIG. 13 is a perspective view of the device for stripping off ice blocks shown in FIG. 12.

DETAILED DESCRIPTION OF PREFERRED EMBODIMENTS

Figure 1:
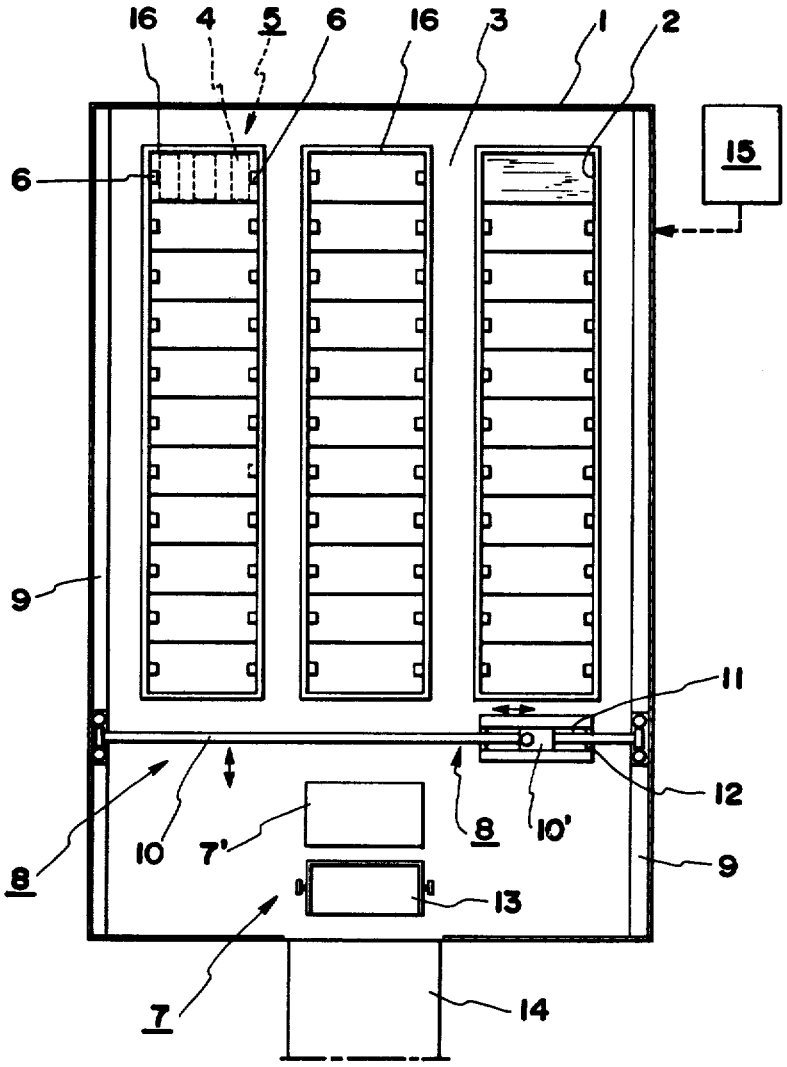
FIG. 1 is a plan view showing a systematic lay-out of an ice making plant in accordance with the present invention.

As shown in FIG. 1, a major portion of the present invention is installed in an ice making room indicated generally at 1. A plurality of arrays of ice making tanks 2 are installed in ice making room 1, with adjacent arrays of tanks being separated by a corridor which permits access to the tanks such as for the purpose of checking and survey.

A plurality of can units 5 each include a plurality of ice cans contained in the ice making tanks 2 over the entire length thereof.

The ice making tanks 2 have an elongated rectangular configuration, and the can units 5 are arranged in a long straight train.

Each of the can units 5 is provided with a pair of lugs 6 which stand up from the longitudinal upper ends of the can unit body and are bent outwardly. Due to the above-mentioned arrangement of the can units 5, an array of lugs 6 is formed with regular and straight spacing along the longitudinal side edge of the ice making tank 2.

A necessary amount of freezing brine is filled in the ice making tank 2, which is usually cooled and circulated by means of a suitable brine freezing system.

An overhead travelling crane 8 is installed which travels between the ceiling of the ice making tank and that of an ice taking-off or stripping-off area 7.

Although the construction of the travelling crane will be described in detail hereinbelow, in this preferred embodiment of the present invention the crane 8 comprises a pair of rails 9 laid along the two opposite side walls of the ice making room 1. A girder 10 is bridged between the two rails and is adapted to travel on the rails 9. A trolley 10' is adapted to run on the girder 10, transversely relative to the building. A hoisting hook 11 is suspended from the trolley 10' and a pair of hooks 12 is provided at the lower tip end of hoisting hook 11, the hooks 12 being arranged to oppose each other.

In operation, positioning of hoisting hook 11 relative to the desired ice making tank 2 is made by the travel of trolley 10' of crane 8 on girder 10. Next, the position of the can unit 5 is located by the travel of girder 10 on rails 9. Thereafter, the hooks 12 are guided to move below the arrays of lugs 6 to be positioned at substantially the same height thereof, and are set in a position just below the pair of lugs 6 of the can unit 5, at which position the hooks 12 are to be engaged for lifting.

Next, the hooks 12 are hoisted up to secure tight engagement between the two mating members, and to further lift the can unit 5.

At the ice taking-off area 7, there is placed an ice melting tank 7' filled with water, into which the can unit 5 is dipped so that the surfaces of the ice blocks which are in frozen contact with the inside surface of the ice can may be partially melted to release the ice blocks from the can unit.

In front of ice melting tank 7', there is provided an ice stripping-off device 13 which receives the can unit 5 from the hooks 12 of the travelling crane to hold and tilt it so as to permit each ice block to leave each ice can 4.

In front of the ice stripping-off device 13 there is provided a dispatching chute 14 which guides the ice blocks which have been released from the ice cans as they slide down to a dispatching area.

The entire device and/or equipment in the ice making room is preferably automatically controlled by a suitable control system.

The lay-out of the present invention with respect to the correlation between the crane 8 and ice making tanks 2 has been explained in detail in the above-described embodiment, however, the present invention is not limited only to the embodiment as shown in FIG. 1, and many modifications and alternatives may be employed.

As can be clearly understood from the above, the can units 5 each comprising several ice cans 4, are aligned in a straight line in each of a plurality of ice making tanks 2. In this manner, the lugs 6 of the can units 5 in an ice making tank 2 are placed in regular alignment with constant spacing. Thus, selective engagement of the hook device 11 of the overhead travelling crane 8 with the pair of lugs 6 of the desired can unit 5 can be made by a mere linear translation of the overhead crane. The selected can unit 5 can be lifted and transferred together with a cover lid 16 provided thereon and other devices or accessories attached thereto. As will be described in detail hereinbelow, the cover lid 16 is opened or closed with respect to the related can unit 5 at the ice taking-off area 7 by means of the overhead crane 8.

Necessary piping for supplying air or water, such as for exchanging the core water, extending from the supply sources in the plant to each ice can when the can units 5 are placed in the ice making tank 2, are detachably connected with a respective main pipe by means of suitable joints.

A detailed explanation of the major devices of the present invention, such as the ice cans, ice can units, overhead crane, lifting hook device, and piping, will now be given with reference to the accompanying drawings, particularly FIGS. 2–15.

Figure 2:
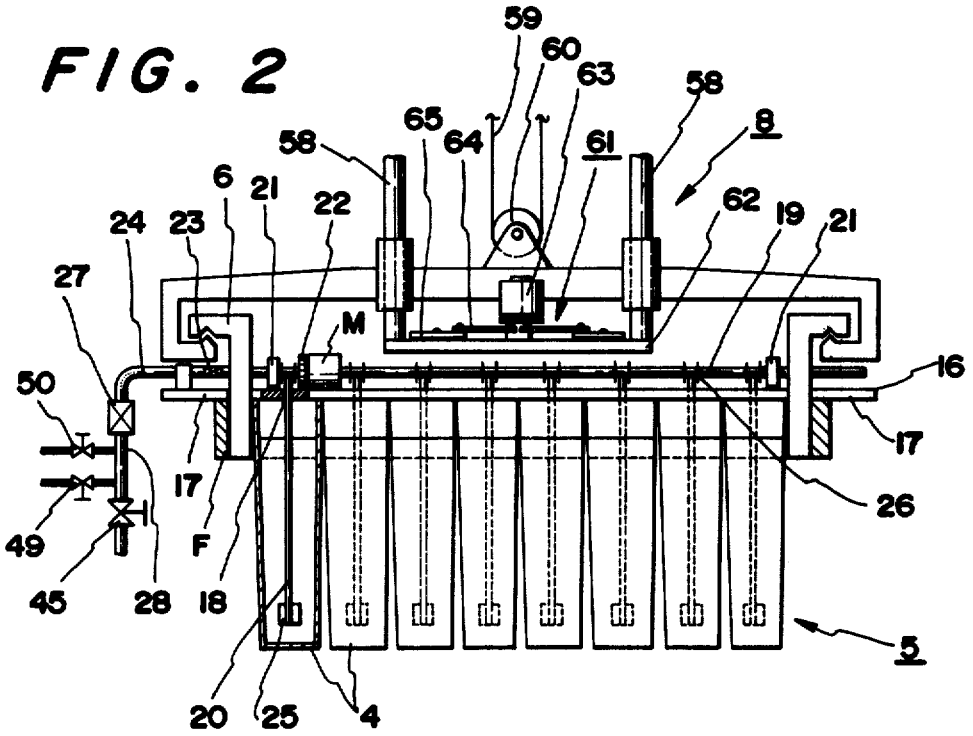
FIG. 2 is a front view showing an ice can unit comprised of a plurality of ice cans in a group together with various means in connection with the can unit, as well as a lifting member of an overhead travelling crane positioned relative to the ice can unit.
Figure 3:
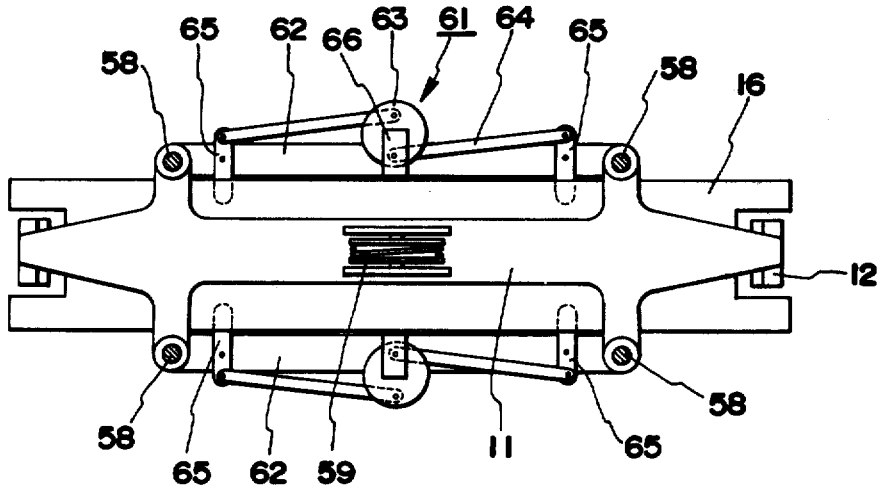
FIG. 3 is a plan view showing a part of the lifting member assembly of the overhead travelling crane.

As shown in FIG. 2, a plurality of ice cans 4 are aligned into an array as a unit by means of a frame F. Each ice can 4 is provided with a pair of tapered side faces such that the upper rim portion is wider than the bottom rim portion. At the opposite ends of each array is provided a pair of lugs 6 each having an inverted L shape cross section and resembling a trunnion. In this manner, a can unit 5 is formed, upon which a cover lid 16 is placed to cover all ice cans 4 in the unit.

Figure 5:
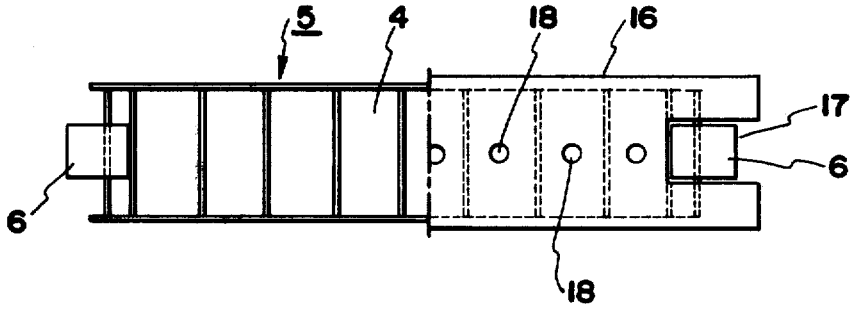
FIG. 5 is a plan view of the can unit comprised of a group of ice cans and a cover lid partially cut-away.
Figure 6:
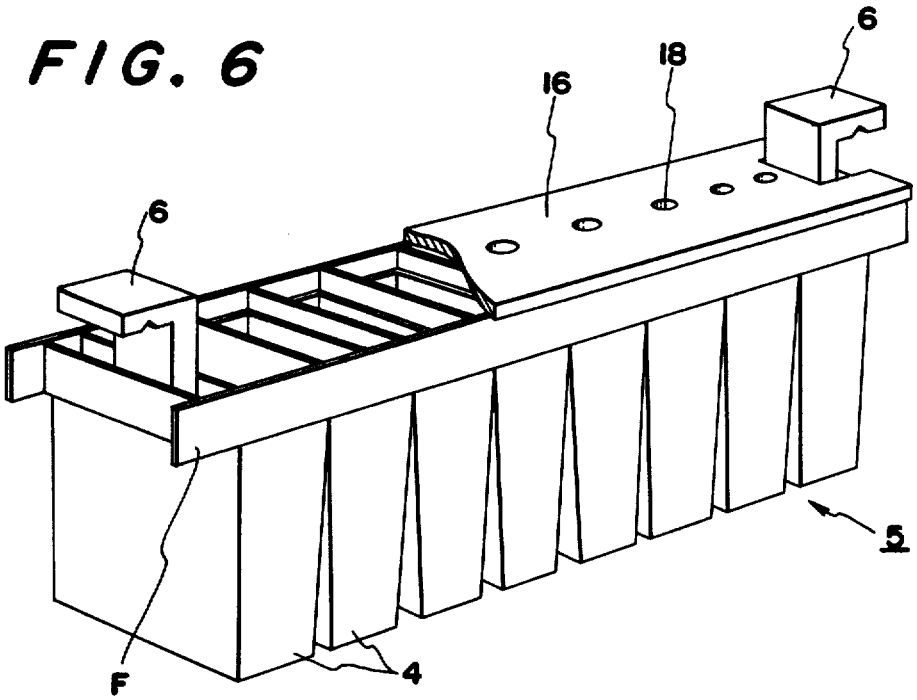
FIG. 6 is a perspective view of the can unit comprised of a group of ice cans with the cover lid partially cut-away.

In cover lid 16 there is defined a pair of recesses at longitudinally opposite ends thereof, and a number of holes 18 are formed at places corresponding to the center of each ice can 4 as shown in FIGS. 5 and 6.

As shown in FIG. 2, a pipe unit comprising a branch pipe 19 and sub-branch pipes 20 is arranged above the cover lid 16, to form a part of the piping for supplying air and for exchanging core water in the ice cans 4. The branch pipe 19 is journally supported by bearings 21 fixed on the top of cover lid 16, and is arranged to be rotated at reduced speed by means of a motor M and gear means 22. At one end of branch pipe 19 a swivel joint 23 is provided. Over the cover lid 16 and at an extension of branch pipe 19 an elbow pipe 24 is mounted with one end thereof connected to swivel joint 23 and the other end thereof being supported to open downwardly at a location outside the longitudinal extremity of cover lid 16.

The sub-branch pipes 20 are connected to pipe 19 at the portions thereof immediately above the holes 18, and are suspended from branch pipe 19 through holes 18 into the interior of ice cans 4. Each sub-branch pipe 20 is fabricated of a flexible material such as rubber or vinyl and is provided at a lower end thereof with a weight 25 having a diameter slightly larger than that of the hole 18. Thus, the weight 25 is blocked by the hole 18 and is restricted from passing through the hole and from moving further upwardly when the pipe 20 is lifted. In this manner, the weights 25 act as stoppers.

Figure 4:
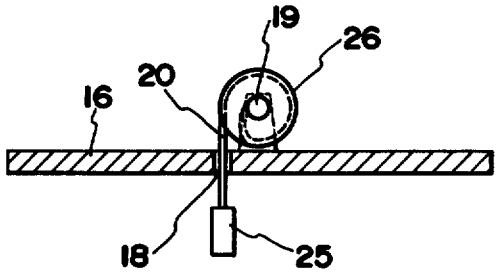
FIG. 4 is a side view showing a reel device in a state of hoisting up a branch pipe.

At axially opposite sides of the portions of the branch pipe 19 at which the pipes 20 are connected therewith, several pairs of reel plates 26 are attached so that the sub-branch pipes 20 can be wound about the branch pipe 19 and between the pair of reel plates when branch pipe 19 is rotated by means of motor M, as shown particularly in FIG. 4. Although not shown in the drawings, the branch pipe 19 can also be manually operated by means of a handle wheel or crank means.

As shown in FIG. 2, the branch pipe 19 is connected to elbow pipe 24 through swivel joint 23. The elbow pipe 24 is connected to a downwardly-opening shorter tube 24' (FIG. 10) which is detachably connected through a joint means 27 to a main pipe 28 which is extended into the corridor area 3 of the ice making plant along the ice making tank 2. The main pipe 28 is connected to the lower end of the plug-and-socket type joint means 27, a socket body of which opens upwardly.

Figure 10:
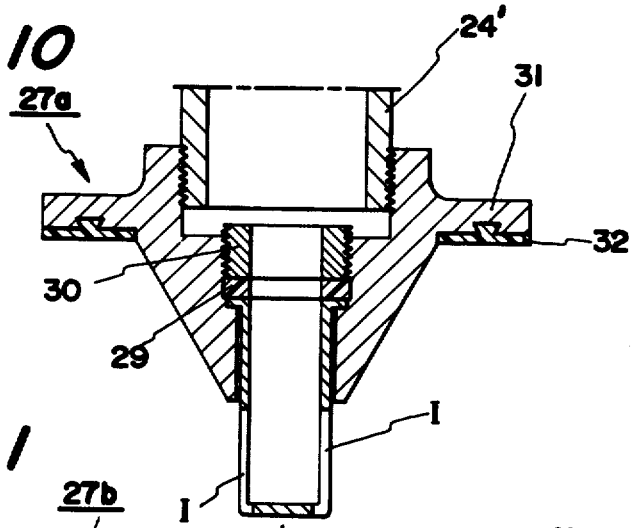
FIG. 10 is a longitudinal sectioned view of the plug of a plug-socket joint assembly for connecting and disconnecting the pipe line.
Figure 11:
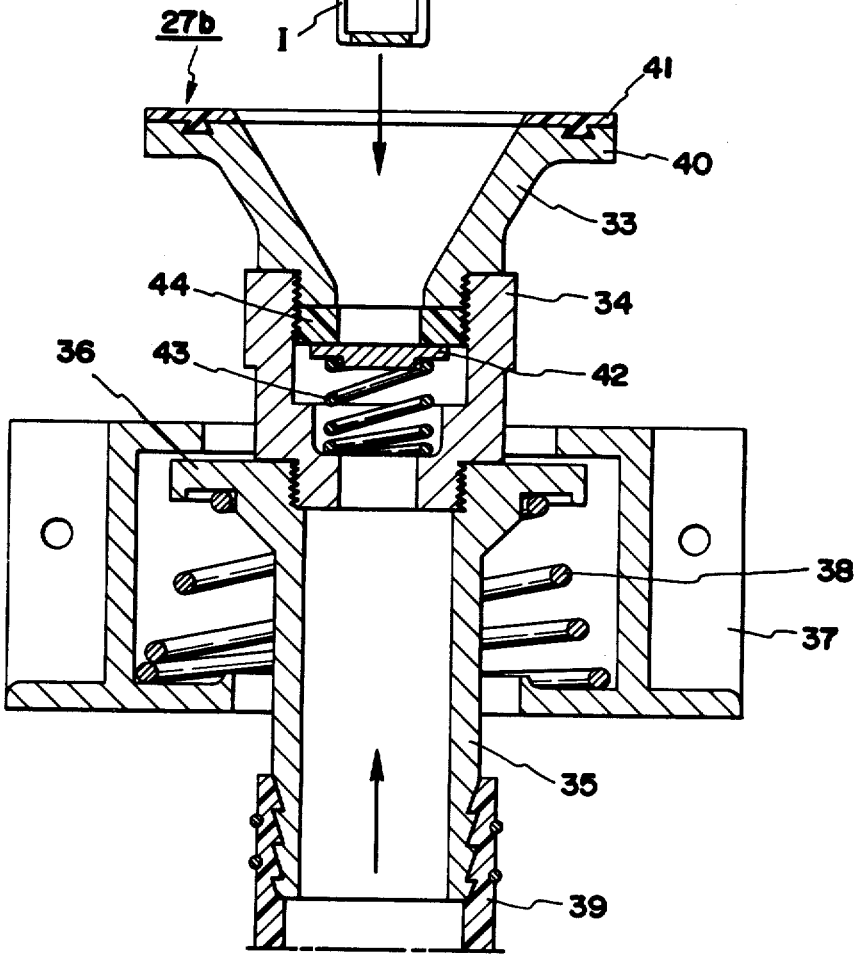
FIG. 11 is a longitudinal cross section of the socket of the plug-socket type joint assembly.
Figure 14:
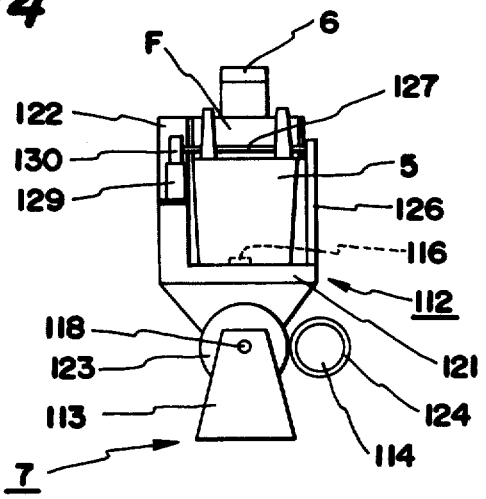
FIG. 14 is a front view of the device for stripping off ice blocks.
Figure 15:
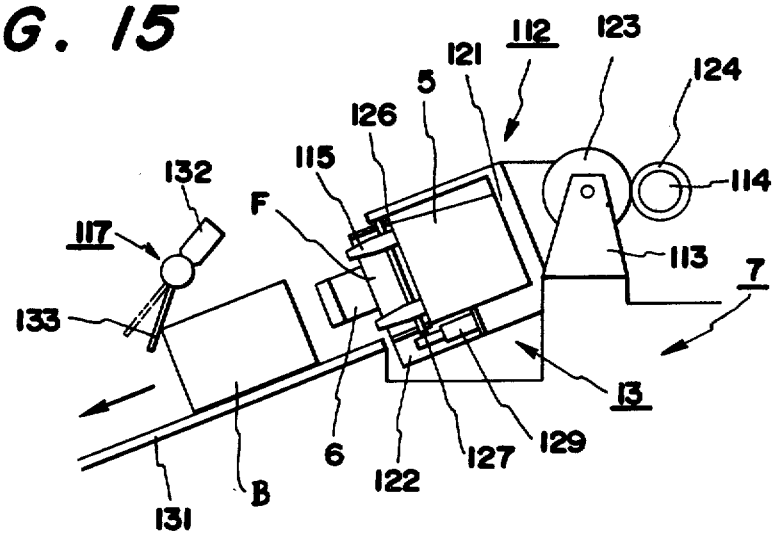
FIG. 15 is a front view of the device for stripping off ice blocks, shown in a stripping-off position.

Construction of the plug-and-socket type joint 27 will be explained in detail with reference to FIGS. 10 and 11. The joint 27 comprises a plug **27*a* as shown in FIG. 10 and a socket 27*b* as shown in FIG. 11. The plug 27*a* shown in FIG. 10 includes a truncated conical body portion, the lower tip end of which is connected to an insertion tube I. The insertion tube I is connected at the upper end thereof to short tube 24' connected to the elbow pipe 24. The insertion tube I is threadedly fixed to the body of plug 27*a* by means of a threaded member 30 and an interposed packing 29. The body of plug 27*a* includes a flange portion 31, the lower face of which is provided with a ring-shaped rubber packing 32**.

With reference now to FIG. 11, the socket **27*b* includes a hollow funnel portion 33, a hollow cylindrical main body 34 and a hollow connecting tube 35 successively assembled by means of screw thread connection. The connecting tube 35 has an annular flange portion 36 at its upper end and is received in a housing 37 while being resiliently supported at the flange 36 and on the housing 37 by a spring 38. Thus, the socket unit 27*b* as a whole is resiliently supported on the base of housing 37. The spring 38 is of the conical coil spring type having a larger diameter at its lower side, and is thus able to resiliently support, to some extent, the whole unit including the connecting tube 35** against displacement in the horizontal direction.

The lower part of connecting tube 35 is connected with a flexible hose 39 which is in turn connected to the main pipe 28. The funnel 33 has a flanged part 40 at its upper end on which an annular packing 41 is provided. Within the main body 34 there is provided a valve 42 which is resiliently urged upwardly by a coil spring 43, thereby urging valve 42 to resiliently seat on a packing 44 placed between the lower end of funnel portion 33 and the valve 42.

When it is necessary to connect the plug **27*a* with the socket 27*b*, the plug 27*a* has only to be moved axially downwardly (as shown by the arrow) toward the socket 27*b*. During this movement of the plug, there may arise a minor amount of misalignment with respect to the concentricity of the two mating parts. However, the two parts are readily guided and assembled by virtue of the tapers of the two mating surfaces, viz., the funneled inside surface of socket 27*b* and the truncated conical portion of plug body 27*a***.

Even when the extent of eccentricity is somewhat large, there will not arise any substantial difficulty in assembly, because the socket **27*b* is connected to the flexible hose 39 and is resiliently supported on the spring 38. Thus, the connecting tube 34 can be displaced in horizontal and vertical directions such that the plug 27*a* tightly engages with the funnel 33 until the flange 36 abuts the housing 37**.

Finally, the plug **27*a* and the socket 27*b* are tightly connected together by means of the packing 32 under the flange 31 and the packing 41 on the flange 40** of the respective bodies, to ensure air tightness between the two parts.

When the plug **27*a* is tightly assembled to the socket 27*b*, the insertion tube I within the assembly abuts the valve 42 and pushes it to move downwardly against the force of coil spring 43 so as to open the valve 42. Thereby, passage of water between the two parts of the joint assembly 27 is established. When the plug 27*a* is pulled out away from the socket 27*b*, the socket 27 itself and the valve 42 revert back to their initial positions as shown in FIG. 11 by means of the springs 38 and 43**, respectively, and thus the circuit of the air or water is blocked.

In this manner, the can units 5 together with supplemental means such as the cover lids 16, the branch pipes 19, and the sub-branch pipes 20, are placed in the ice making tank 2, and at the same time the branch pipes 19 are connected to the main pipe 28. The can unit 5 is also lifted up and away from the ice making tank 2 with its branch pipes 19 disconnected from the main pipe 28.

The piping circuit for supplying air and for exchanging core water in the ice cans 4 will now be described in detail with reference to FIGS. 2 and 9 which show such piping circuit more clearly. A stop valve 45 is connected to main pipe 28 on the upstream side of socket type joint means 27. A pair of piping lines 46 for exchanging core water comprise a feed pipe 47 and a return pipe 48, connected to the main pipe 28 between the plug-and-socket type joint 27 and the stop valve 45 in a branch-off fashion. The feed pipe 47 and the return pipe 48 are provided with their own stop valves 49, 50, respectively. These feed and return pipes 47 and 48 communicate with each other through a series circuit including a suction pump 51, a filtration tank 52 and a water supply pump 53.

Figure 9:
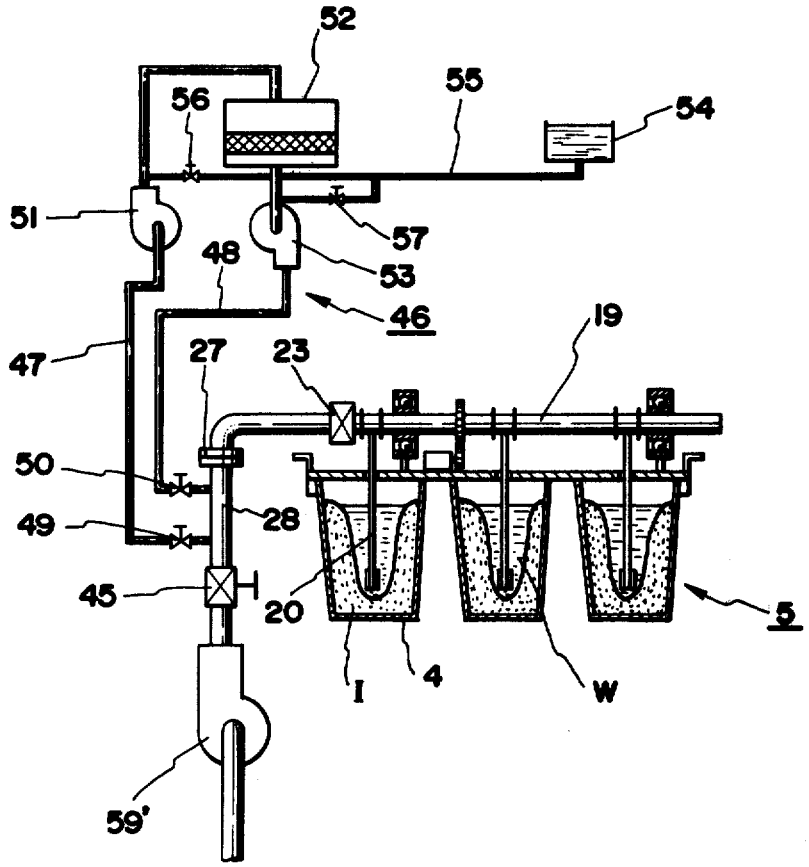
FIG. 9 is a schematic illustration of a piping for admitting air into the ice cans and exchanging core water with fresh water.

In FIG. 9 there is shown a tank for supplying priming water designated at 54, from which there is provided a lead pipe 55 extending through a valve 56 on the upstream side of suction pump 51, and extending through a valve 57 to the point after the water supply of discharge pump 53. Also shown is a blower 59'.

With such piping circuit arrangement, when the blower 59' is operated with the stop valve 45 opened, and with the stop valves 49 and 50 particularly for exchanging core water being closed, there is supplied fresh air into the individual ice cans 4 out of the tip ends of the sub-branch pipes 20, thus resulting in an agitating effect with air bubbles on the water material in the ice cans 4.

In due time, ice formation generally progresses from around the inner circumference of the individual ice cans 4 toward the center or core thereof. During the formation of an ice block within each ice can 4, there remains water or core water W, in which all impurities or foreign particles from the water material, viz., the water used for the ice making, will be left concentrated. Consequently, it is necessary to remove such impurities or foreign particles in a suitable manner. For this purpose, by closing the stop valve 45 while opening the stop valves 49 and 50, the suction pump 51 is driven so as to suck up the core water W remaining within the individual ice cans 4. The thus removed core water is then redirected to the filtering tank 52, and is filtered. Thereafter, the clean filtered water is supplied into the core cavity of an ice block by means of the water supply pump 53.

After the above procedure has been completed, the stop valves 45, 49 and 50 are set back to their original positions for resumption of the air supply operation.

Upon the completion of such ice forming procedures, the overhead crane 8 is operated to lower its hoisting hook 11 so as to upwardly lift a selected ice can unit 5. This ice-block lifting operation is particularly shown in FIG. 7.

Figure 7:
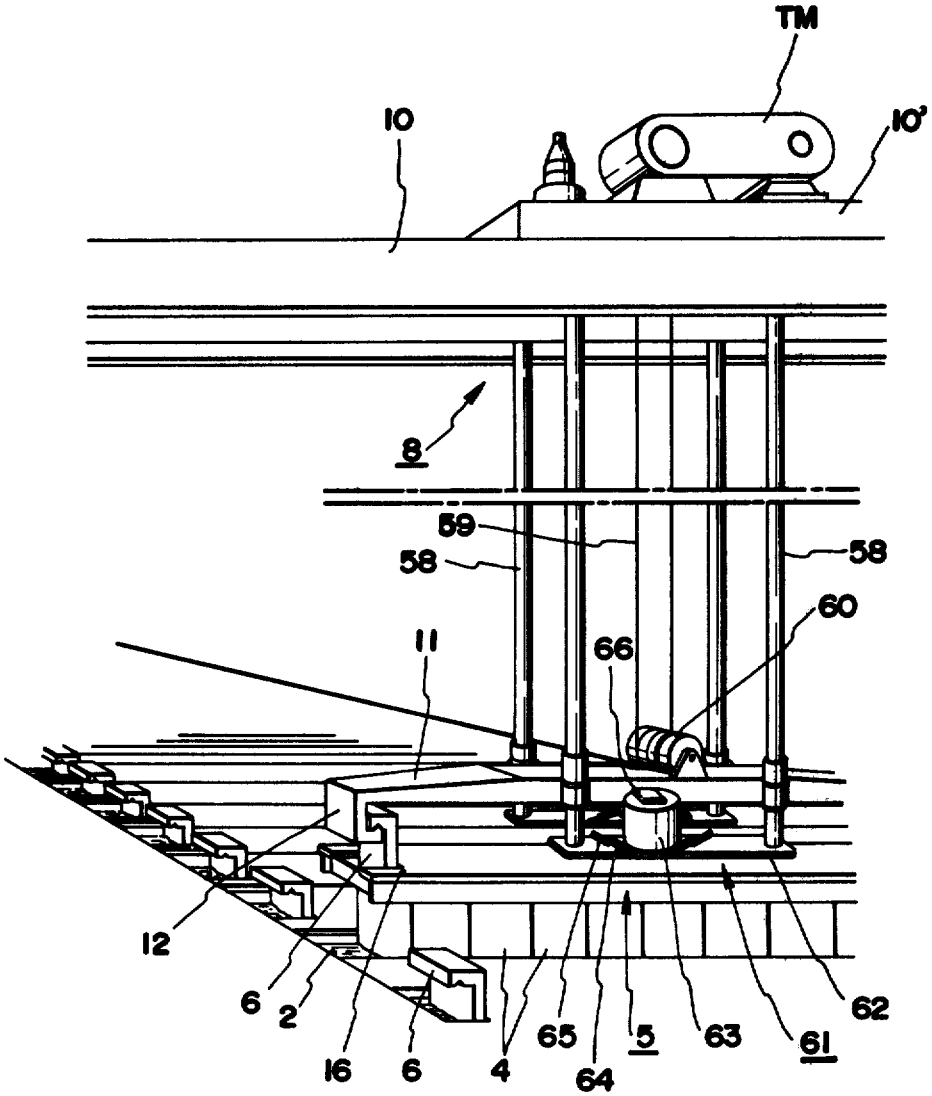
FIG. 7 is a perspective view partially cut-away, showing the overhead travelling crane in the state of lifting up one of the can units from an ice tank containing arrays of ice cans.
Figure 8:
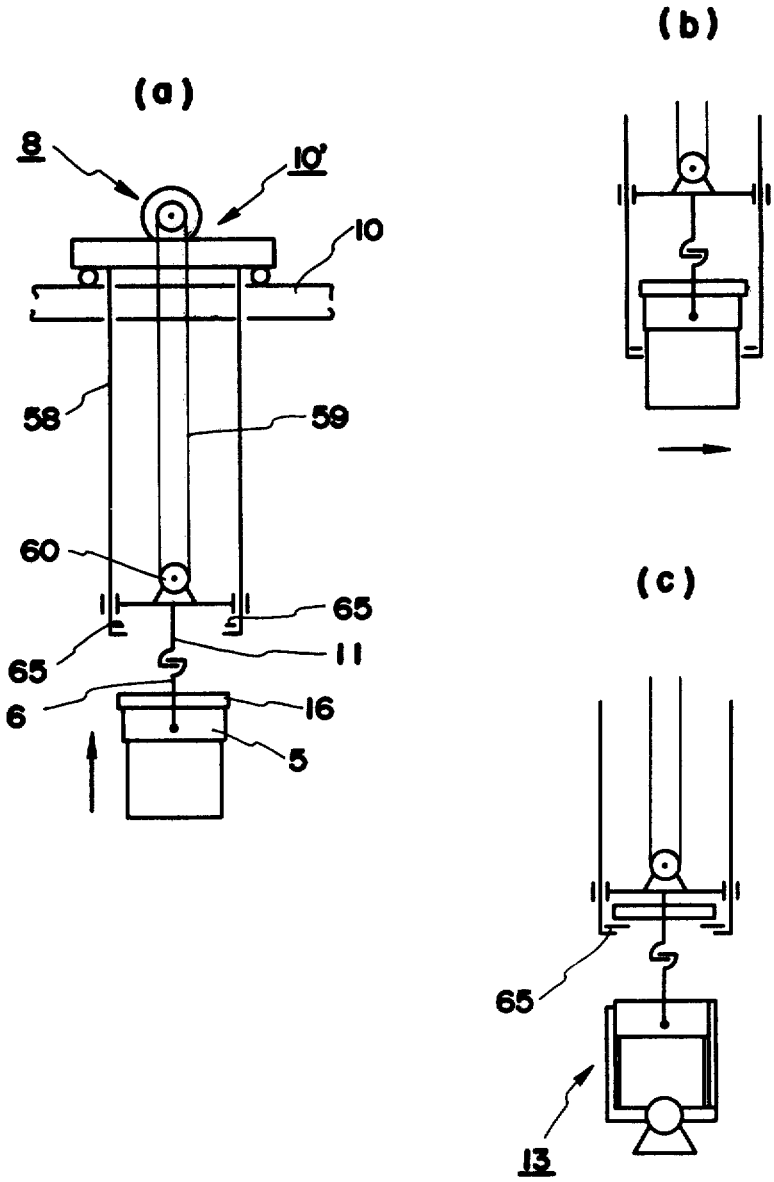
FIGS. 8*a–c* schematically show the sequential steps of lifting an ice can unit, transferring it, and lowering the ice can unit away from the cover lid.

As best seen in FIG. 7, the trolley 10' is movably guided upon girder 10, and two pairs of guide rods 58 depend downwardly from trolley 10'. Along with guide rods 58, the hoisting hook 11 is guided so as to be slidably elevated in the vertical direction to a desired height. Hoisting hook 11 is adapted to be elevated in the vertical direction by the combination of a wire 59 and a set of movable pulleys 60 depending from an electric motor TM mounted on trolley 10'. On each end of hoisting hook 11 there is provided one of the pair of hooks 12 extending downwardly and then inwardly so that the tip ends of the hooks 12 are arranged to oppose each other.

When the pair of hooks 12 is lowered to an appropriate level near the pair of lugs 6 of the selected ice can unit 5 so as to effect mating therebetween, the selected ice can unit 5 can then be lifted upwardly by the engagement of the pair of hooks 12 with the pair of mating lugs 6. The ice can unit 5 thus lifted upwardly by the overhead crane 8 is then delivered to the ice stripping-off or taking-off area 7 which is best seen in FIG. 1.

At the ice stripping-off area 7, the cover lid 16 is then opened, with the ice can unit 5 being lifted as it is, and only the ice can unit 5 is shifted over the ice stripping-off device 13. This lifting-up operation of cover lid 16 is performed by using a chuck device 61 as shown in FIG. 7, as well as FIGS. 2 and 3.

The chuck device 61 comprises a pair of frames 62 fixedly mounted at the lowest ends of guide rods 58; a pair of actuators 63 carried on the pair of frames 62; two sets of links 64 operatively connected to actuators 63; and two sets of chucks 65 operatively connected to the sets of links 64 and mounted on the pair of frames 62 so as to be pivotable in the horizontal direction.

The pair of frames 62 comprise a pair of thick metal sheets which extend outwardly to an extent of projection greater than the breadth of cover lid 16. The pair of actuators 63 are respectively mounted upon the pair of frames 62 through a suitable bracket 66.

The two sets of links 64 are caused to move in a cranking motion by a rotating motion of the pair of actuators 63 so as to cause the two sets of chucks 65 to move in opposed rotation beyond and away from the inner sides or edges of the pair of frames 62. With this arrangement, while maintaining the entire ice can unit 5 at a desired elevated level by using the hoisting hook 11 in such a manner that the pair of frames 62 are located at a position or level lower than the cover lid 16, the two sets of chucks 65 will rotatably move beyond the inner edges of the pair of frames 62 so as to extend toward the underside of cover lid 16. Thereafter, when lowering the entire ice can unit 5 downwardly, because the cover lid 16 is held at its original position by the function of the two sets of chucks 65, the entire ice can unit 5 may be lowered with its cover lid 16 being lifted up.

The operations of lifting the ice can unit by using the overhead travelling crane 8 are sequentially shown in FIGS. 8*a* through 8*c*.

As shown in FIG. 8*a*, the entire ice can unit 5 is hoisted upwardly from the ice making plant, and then delivered over the ice stripping-off area 7 with the two sets of chucks 65 being positioned at a height under the cover lid 16, while maintaining the entire ice can unit 5 at an elevated level.

Upon arrival at the ice stripping-off area 7 as shown in FIG. 8*c*, the two sets of chucks 65 are caused to extend and project toward the underside of cover lid 16 and thereafter the entire ice can unit 5 is lowered to rest in position on the ice stripping-off device 13. Simultaneously, the cover lid 16 is held at its original position by the two sets of chucks 65, and thus the ice can unit 5 is now opened so that an ice block within the ice can unit 5 may be stripped therefrom.

After the ice block has been stripped off as desired, the entire ice can unit 5 is filled up with the water material, i.e., the water for making the ice, in the individual ice cans 4. Thereafter, the ice can unit 5 is delivered back to the ice making plant in the reverse sequence of steps to that of the ice block stripping-off operations.

Referring now to FIGS. 12 through 15, there is shown a general view of the ice block stripping-off device 13 as well as the steps of the ice block stripping-off operation.

As best shown in FIGS. 12 and 13, the ice block stripping-off device 13 is mounted on a base block 113 in such a manner that the device 13 may selectively take either an upright position or a tilted position by way of a tiltable stand 112 which is tiltably pivoted about a swivel shaft 118 in base block 113. The tilt stand 112 is formed with an upper flat base portion 121 having an upper flat surface and an upright back portion 122 standing upright from the edges of the upper flat base portion 121. Thus, tilt stand 112 has a generally L-shaped when viewed from the side thereof. The swivel shaft 118 is fixedly mounted on stand 112, and a driven gear 123 is secured about pivot shaft 118. A driving means, such as an electric motor 114 having a driving gear 124 on its output shaft, which driving gear engages with the driven gear 123 on pivot shaft 118, is also provided. When the electric motor 114 operates in the forward or rearward directions, the tiltable stand 112 will be caused to tilt accordingly. A counter shaft 125 is also provided.

In this embodiment, there is illustrated, by way of example, a power train comprising the electric motor 114 as a drive means, and further as power transmitting means the driving gear 124, the driven gear 123, and the counter shaft 125 as described above. However, it is to be understood that such arrangement is not restrictive in any way, and any other type of driving means such as an actuator, power cylinder, or the like, may be used. When employing an actuator, for example, an output shaft of such actuator may be operably connected to swivel shaft 118. In the case of a power cylinder, a piston rod thereof may be operatively connected to the tilt stand 112.

At both corners of tilt stand 112, there are provided upright pillars 126 as best seen in FIG. 13. Also provided is a pair of rotating shafts 127, each having a pair of holder hooks 115 fixed thereon and extending between the upper ends of the upright portion 122 and each of the upright pillars 126.

At one end of the rotating shaft 127 there is securely mounted a pinion 128. Also provided is a power cylinder 129 including a rack 130 on its piston rod. The power cylinder 129 is mounted on the upright portion 122 in such a manner that the rack 130 on the piston rod may engage the pinion 128. With such arrangement, when the power cylinder 129 is operated, the pair of holder hooks 115 on the rotating shaft 127 are caused to rotate so as to engage a frame F rigidly mounted on tilt block 112.

A pressure sensitive switch 116 (FIG. 12) is provided as means for detecting or sensing loading of the ice can unit 5 upon the upper surface of the flat base portion 121.

Also provided is a sliding chute 131 (FIG. 15) having an inclination such that the inclined chute will form a continuous surface extending in alignment with the upright portion 122 of tilt stand 112 when tilt stand 112 is tilted. There is also provided means 117 for detecting a discharge or stripping-off state of an ice block out of ice can 4 onto the upper end of the sliding chute 113.

The detecting means 117 includes a sensing lever 133 which functions to detect a discharge of an ice block when it is caused to forcibly rotate by passage of the ice block so as to operate a sensing device 132.

Because there are nine ice cans 4, for example, located in one ice can unit 5, nine blocks of ice slide out of the ice can unit when tilted. Accordingly, there are provided nine of such detecting means 117 so as to detect the individual ice blocks sliding out of the ice can unit 5 along the sliding chute 133.

When detecting loading of the ice can unit 5 upon the upper flat base portion 121 of the tilt stand 112, the pressure sensitive switch 116, the electric motor 114, the power cylinder 129 and the detecting means 117 will operate in the following manner.

Upon engagement of holder hooks 115 with frame F of ice can unit 5 through the actuation of power cylinder 129, the electric motor 114 starts running and tilts the tilt stand 112.

Upon detection of a series of discharged ice blocks by the detecting means 117, the electric motor 114 starts running in the reverse direction so as to cause the tilt stand 112 to be turned back to its original position. At the same time, the power cylinder 129 is connected to a circuit (not shown) which functions to release the engagement of the holder hooks 115 with the frame F.

When the ice can unit 5, comprised of a set of ice cans bound together with the frame F, is suspended by a hook means on a travelling means and is disposed upon the flat base portion 121 of tilt stand 112, the pressure sensitive switch 116 will detect loading of the ice can unit 5 by the weight thereof. Upon detection of the ice can unit, the power cylinder 129 operates to run the holder hook 115 through the operation of rack 130, pinion 128 and rotating shaft 127, so as to positively hold the frame F of the ice can unit 5 in position. At the same time, the electric motor 114 runs to operate the driving gear 124, the driven gear 123 and the pivot shaft 118 so that the tilt block 112 is caused to tilt toward the ice block dispatching chute 14.

With such sequence of operation, a plurality of ice blocks B are stripped-off from the individual ice cans 4 as desired. Simultaneously, the detecting means 117 detects stripping-off of all the ice blocks out of the ice cans 4, and there is then generated an electric signal. In response to such electric signal, the electric motor 114 starts running in the reverse direction so as to cause the tilt block 112 to be turned back to its original position.

At an appropriate time during such turning-back motion of tilt block 112, the power cylinder 129 is operated in the reverse direction to the state as described above so as to cause the holder hook 115 to be rotated in the reverse direction, thereby releasing the engagement thereof accordingly.

Such operation of power cylinder 129 in the reverse direction is set to occur in such a manner that when a certain time period passes by after the tilt stand 112 starts turning back to its original position, the holder hook 115 is caused to disengage, when the tilt stand 112 turns back well enough that the ice can unit 5 will not come out of the tilt stand 112, free from the engagement by the holder hook 115. For this purpose, there is provided a suitable means such as a timer or the like in circuit.

After discharging the ice blocks and turning back to the original position, the ice can unit 5 is then engaged at its lugs 6 with the hook means of the delivering to transfer means, to thus be delivered to the next step.

The ice block stripping-off device 13 is also prepared for the next ice block stripping-off operation, or receipt of ice blocks from the next set of ice cans 4.

As fully explained in the foregoing description, according to the present invention it is practicably possible by merely placing the ice cans including ice blocks therein upon the tilt stand of the ice block stripping-off device to fully automatically perform a desired series of steps of tilting of the ice cans, discharging the produced ice blocks, confirming such discharge operation, and returning the ice cans to their original position. Moreover, the ice cans can be quickly readied for the next cycle of ice making operations.

It is of course possible to practice to have many modifications and variations of the ice making plant design. As a typical example, there may be provided alternative means for agitating the water material for making ice blocks within the ice cans, instead of air blowing. With such modification, the relatively complicated piping for air supply and core water exchange may be substantially simplified.

By the employment of air blowing, it is possible that the impurities in the atmosphere or the foreign particles in the piping or built-in devices associated therewith may be introduced into the water material or ice making water, which may be one of the causes of possible dirt in the water. The abovementioned modification, therefore, may practicably contribute to the solution of such problem.

Figure 16:
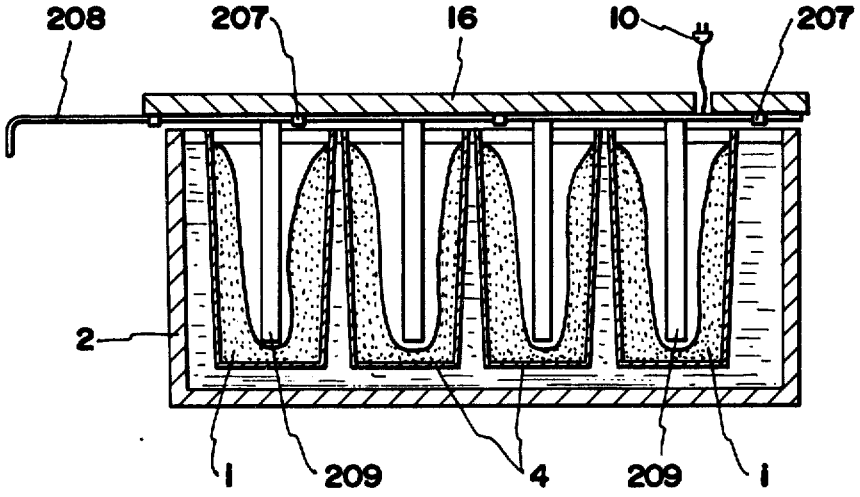
FIG. 16 is a side sectional view of the ice making tank receiving therein a plurality of ice cans each provided with a means for agitating water therein.
Figure 17:
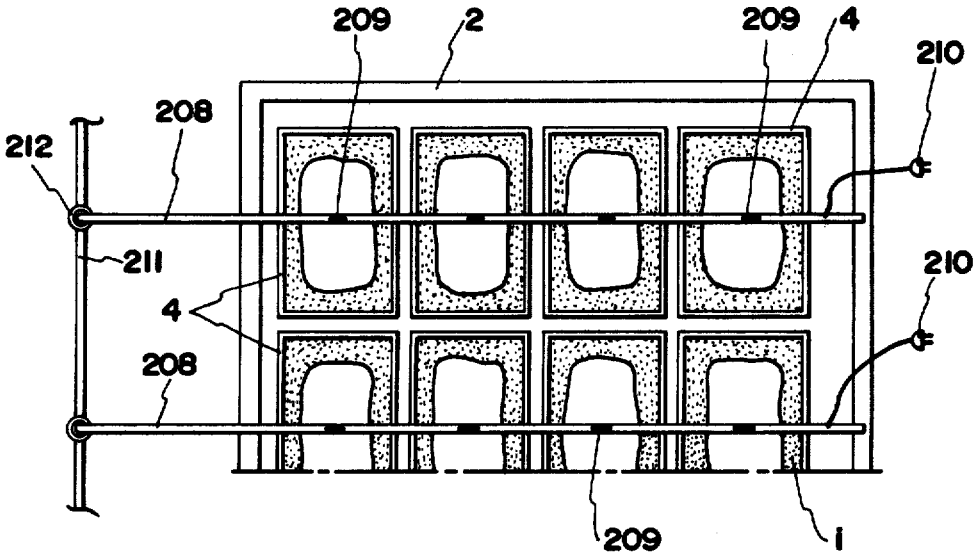
FIG. 17 is a plan view of the ice making tank partially cut-away with its cover lid removed.

Referring now to FIGS. 16 and 17, there is shown a second embodiment of the ice making tank including a water agitating device according to the present invention wherein there is freezing brine that has been cooled down to approximately minus 10° C. within an ice making bath or tank 2. Within the brine there are immersed a plurality of ice cans 4 which are filled with the material or ice making water.

As the water material is cooled with the freezing brine therearound, ice i forms progressively around the inner circumference of the tank 2. The brine is circulated after having been recooled with a freezing brine system (not shown).

The cover lid 16 is provided upon the ice making cans 4 so as to cover the same, thereby serving as a heat insulator as well as an operator's foothold. The cover lid 16 may be shifted upwardly or downwardly by the overhead travelling crane as stated hereinabove.

In this embodiment, there is provided a longitudinal shaft 208 rotatably held by a plurality of holders 207 disposed on the underside of cover lid 16. Longitudinal shaft 208 extends in the horizontal direction so as to extend across the central portions of the individual ice cans 4 according to the number of the ice cans to be arranged side by side. Shaft 208 is operatively connected to a drive means so that it may be rotated alternatively in the forward or rearward directions.

There are also provided a plurality of agitating members 209 fixed on the longitudinal shaft 208 in such a manner that they depend downwardly into each of the individual ice cans 4 corresponding to the number and the lateral spacing of the ice cans so arranged, and that their leading ends are located near the bottom of the individual ice cans 4.

Figure 18:
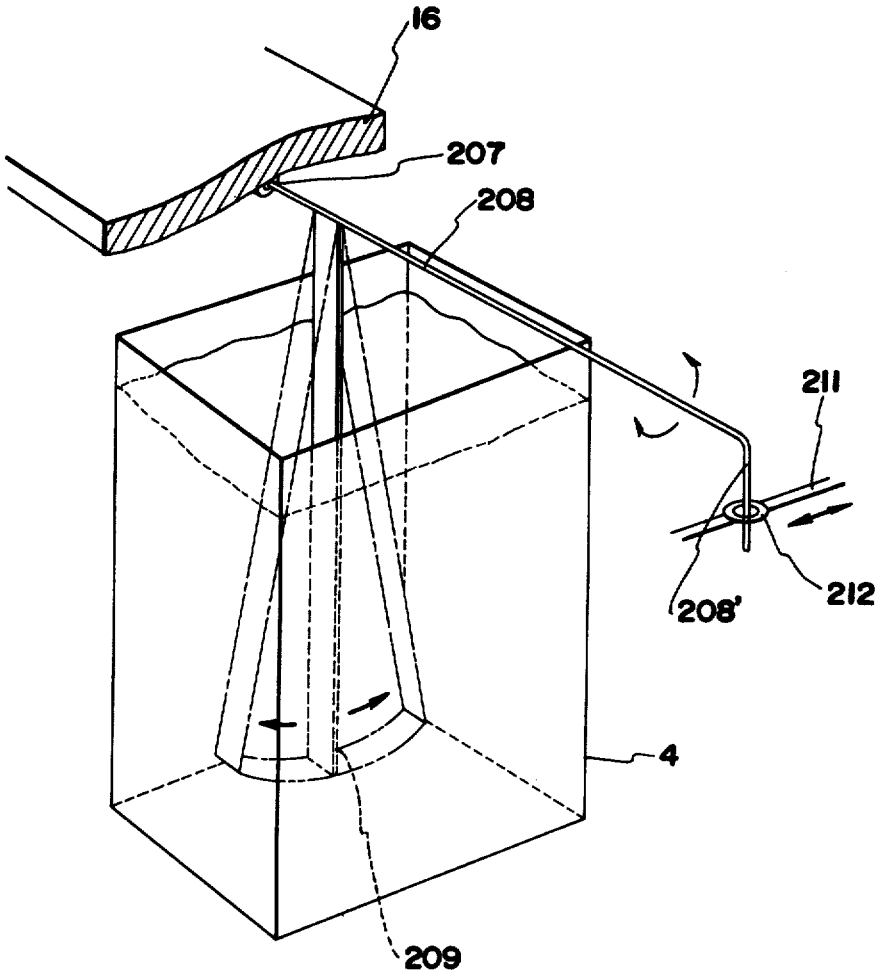
FIG. 18 is a perspective view of an ice can.

With such arrangement, the agitating members 209 may move in swinging motion (oscillating motion) back and forth about the longitudinal shaft 208 as a pendulum, whereby it is possible to continuously agitate the water material during the ice making operation (see FIG. 18).

The agitating member 209 is made of material such as nickle-chromium steel, and having some electric resistance. Therefore, by connecting a connector means 210 to a power supply source, (not shown), it is possible to have the agitating members 209 heated electrically. With such arrangement, ice which would otherwise be frozen together with the agitating members 209 may be melted away at the completion of the ice making operation as desired.

When starting the ice making operation by using the water agitating device according to this embodiment of the invention, the ice making tank 2 is properly covered with cover lid 16 including the rotatable longitudinal shaft 208 which has the plurality of agitating members 209 fixedly mounted thereon, with the agitating members 209 depending downwardly into the water material within the individual ice cans 4. At this state, the electrical connector means 210 is not yet connected to the power supply source (not shown).

Next, when operating the drive source (not shown) so as to drive the longitudinal shaft 208 is a swinging back and forth motion, the plurality of agitating members 209 are caused to swing or oscillate with a predetermined cycle of motion and displacement, thereby agitating the water material within the individual ice cans 4.

As the ice making operation progresses, ice is formed progressively from around the inner circumferences of the individual ice cans 4 toward the center or core thereof, thus completing the ice making operation. At this time, the oscillating motion of the agitating members 209 would normally be stopped due to the ice formed therearound. However, during the step of lifting the agitating members 209 upwardly from the ice making tank, the electric connector means 210 is connected to the power supply source so that the members 209 are supplied with electricity.

Because the agitating members 209 will be electrically heated by an appropriate electric resistance and the ice formed around the members 209 will be melted as desired, the cover lid 16 can now be lifted upwardly, whereby it is possible to remove the cover lid 16 away from the ice making tank 2, and thus complete the agitating member lifting operation.

While in the second embodiment of the invention as stated hereinabove, there is employed an agitating member having a long rectangular shape, the agitating member is not necessarily restricted to such shape, but can take any other suitable shape.

Also, the oscillating motion cycle and the extent of displacement of the agitating member may be appropriately changed in accordance with the progress of ice formation between the beginning and the completion of the ice making operation.

Referring again to the construction of longitudinal shaft 208, the shaft has a downwardly-bent portion 208' (FIG. 18) at its free end, which is beyond the extremity of cover lid 16. When the ice cans 4 are dipped into the ice making tank 2, portion 208' is engaged with a reciprocating link 211 at its ring portion 212 which can be moved in horizontal reciprocal motion by a suitable drive means (not shown).

When the ice cans 4, together with the lid including the longitudinal shaft 208, are hoisted upwardly from the ice making tank 2, shaft 208 is smoothly disengaged from link 211. With such arrangement, it can be seen that the ring portion 212 of the link 211 and the downwardly-bent portion 208' of the longitudinal shaft 208 provide an effectively detachable coupling means between the water agitating device and the drive means.

According to the above-described embodiment of the invention, there are provided agitating members which can, due to their swinging motion, agitate the water material during the ice making operation, and which can be taken off with ease at the completion of the ice making operation, even if left immersed in the ice cans, by virtue of the advantageous feature that the agitating members can be heated electrically.

Moreover, because there is no blowing of compressed air into the water material as has been conventionally known, there is no possibility of contamination of the water material with impurities in the air, and therefore there is made available an advantageous ice making operation from the hygienic engineering viewpoint.

In addition, because there is no need for the air blowing equipment in the ice making plant, such extra work as piping therefor and core water exchanging can be eliminated, thus contributing to the saving of manpower and the minimization of ice making time, resulting in general improvement in ice making efficiency.

We claim:

1. Ice making equipment, comprising:

a plurality of ice cans each provided with lugs for lifting said ice cans, said ice cans being placed in alignment within at least one ice tank in such a manner that said lugs are aligned with regular spaces therebetween;

said ice tank(s) being disposed in an ice-making area;

a plurality of branch pipes and sub-branch pipes mounted on said ice cans, said pipes being adapted to be connected to an air supply source;

means for supplying and treating ice making water, said pipes being adapted to be connected to said supplying and treating means;

said branch pipes being connected to said sub-branch pipes so as to hoist up and lower down said sub-branch pipes;

a plurality of cover lids for covering said ice cans;

an ice stripping-off area provided with means for stripping-off ice blocks formed within said ice cans;

a pair of rails extending between said ice-making area and said ice stripping-off area; and at least one overhead travelling crane adapted to lift and transfer said ice cans with said cover lid placed thereon or unload said ice cans with said cover lid separated therefrom, said crane including:

at least one movable trolley adapted to travel on said pair of rails;

guide rods suspended from said trolley; and a hook device adapted to be raised or lowered while being guided by said guide rods, said hook device being adapted to selectively engage with and support thereon said lugs for lifting said ice cans.

2. Ice making equipment according to claim 1, wherein:

a plurality of said ice cans are arranged in a plurality of ice can units, each of said units including a plurality of said ice cans arrayed together as a group.

3. Ice making equipment according to claim 1, wherein:

a pair of said lugs project in a trunnion-like manner from the upper portion of two opposite side faces of each of said ice cans;

said lugs for lifting said ice cans are adapted to be arranged in straight alignment at a common level of height when said ice cans are received within said ice tank; and said hook device comprises a pair of hooks bent downwardly and inwardly so as to be engageable with said lugs and to be passed under a row of said lugs.

4. Ice making equipment according to claim 1, wherein:

said ice cans are arranged as a plurality of rows of can units, each said unit includes a plurality of said ice cans combined together as a group of cans;

said lugs project in a trunnion-like manner from the upper portion of opposite side faces of said ice cans such that said lugs are adapted to be arranged in straight alignment at a common level of height when said ice cans are arranged as rows of can units; and said hook device comprises a pair of hooks bent inwardly so as to be engageable with said lugs and being adapted to be passed under a row of said lugs.

5. Ice making equipment according to claim 1, wherein:

said overhead travelling crane further comprises a set of chucks adapted to be moved in horizontal directions passing through the lower part of said guide rods so as to protrude for engagement with a bottom side rim of said cover lid and to retract for disengagement therefrom, said cover lid being adapted to be separated from said ice cans by a combined action of the protrusion of said chucks and the lowering of said ice cans by said hook device relative to said cover lid.

6. Ice making equipment according to claim 1, wherein:

said ice cans are arranged as a plurality of rows of ice can units, each said unit including a plurality of ice cans combined together as a group of cans;

said cover lid is adapted to cover all ice cans in one of said can units as a common cover lid; and said overhead travelling crane is provided at a lower part of said guide rods with chuck means adapted to move in a horizontal direction to protrude or retract beneath a bottom side rim of said cover lid, said cover lid being adapted to be separated from said ice cans by the combined action of the protrusion of said chucks and the lowering of said can unit by means of said hook device.

7. Ice making equipment according to claim 5, wherein:

said chucks are operated either to protrude beyond, to engage with, or to retract from the lower face of said cover lid by means of a driving means and a link operatively associated therewith.

8. Ice making equipment according to claim 6, wherein:

said chucks are operated either to protrude beyond, to engage with, or to retract from the lower face of said cover lid by means of a driving means and a link operatively associated therewith.

9. Ice making equipment according to claim 1, including:

a can unit comprising a plurality of said ice cans, a branch pipe, and a plurality of sub-branch pipes connected together to define a manifold such that said branch pipe is detachably connected to a main pipe through which air and water for making ice blocks are supplied or treated;

each of said sub-branch pipes being suspended from said branch pipe toward the center of each ice can; and said branch pipe also acting as an actuating means for hoisting up and lowering said sub-branch pipe.

10. Ice making equipment according to claim 9, wherein:

said sub-branch pipe is made of a flexible material, and is carried by a hoisting up means including said branch pipe so as to be capable of being taken up or lowered down; and said sub-branch pipe is introduced into an ice can through a hole in said cover lid.

11. Ice making equipment according to claim 10, wherein:

said sub-branch pipe is provided at the lower portion thereof with a weight having a diameter larger than the inside diameter of said hole defined in said cover lid.

12. Ice making equipment according to claim 10, wherein:

said branch pipe is supported as a rotatable axis of said hoisting up means, and is capable of being rotated through a swivel joint whereby said sub-branch pipes can be taken up or lowered down by rotating said branch pipe.

13. Ice making equipment according to claim 1, including:

actuating means connected to said means for supplying and treating ice making water, comprising a branch pipe, and sub-branch pipes suspended from said branch pipe toward the center of each ice can, whereby said branch pipe and sub-branch pipes cooperate to suck out core water gathered in a cavity formed near the center of the ice blocks during an ice making step, and to charge fresh ice making water in said cavity.

14. Ice making equipment according to claim 13, wherein:

said sub-branch pipes are made of a flexible material and are adapted to be taken up or lowered down by a hoisting means, each said sub-branch pipe being introduced into an ice can through a hole formed in said cover lid.

15. Ice making equipment according to claim 13, wherein:

a weight is provided at the lower end of each said sub-branch pipe, the diameter of said weight being larger than the inside diameter of the hole formed in said cover lid.

16. Ice making equipment according to claim 13, wherein:

said hoisting means comprises a branch pipe defining a hoisting axis and being rotatably supported by means of a swivel joint, said sub-branch pipes being taken up or lowered down by rotation of said branch pipe.

17. Ice making equipment according to claim 1, wherein:

said means for supplying and treating ice making water comprises a plurality of branch pipes forming a part of hoisting means, said branch pipes being detachably connected to a main pipe;

a connection between said main pipe and said branch pipes is made by a plug-and-socket type joint comprising a conical plug protruding outwardly and a socket having a conical hollow funnel portion, the inside surface of which guides said plug;

either one of said plug or socket is movably supported on a fixed part with sufficient clearance between the mating portions such that connection to the sources for supplying and treating the ice making water and for supplying air can be made; and said equipment further includes valve means for blocking the flow passage when said plug and socket are released from relative engagement.

18. Ice making equipment according to claim 1, wherein:

said means for stripping-off ice block comprises at least a tilt stand attached on a base seat for mounting said ice cans, a driving source for tilting and raising said stand, means for engaging said ice cans with said tilt stand, first means for sensing said ice cans when they are mounted on said tilt stand, second means for sensing when said ice cans have left said tilt stand, and a control device for sending signals to said driving source in response to signals from said first and second sensing means.

19. Ice making equipment according to claim 18, wherein:

said tilt stand comprises a flat base portion and a back portion extending upwardly from said base portion, said tilt stand having a substantially L-shaped cross section.

20. Ice making equipment according to claim 18, wherein:

said tilt stand comprises a swivel shaft by which said tilt stand is mounted to said base seat, a reducing gear means, a transmission device, and an electric motor driving source, said swivel shaft and said electric motor being connected via said reducing gear means and said transmission device.

21. Ice making equipment, comprising:

a plurality of ice cans each provided with lugs for lifting said ice cans, said ice cans being placed in alignment in at least one ice tank in such a manner that said lugs are aligned with regular spaces therebetween;

said ice tank(s) being disposed in an ice-making area;

actuating means including a branch pipe, said branch pipe being mounted on each said ice can;

separately-installed means for supplying air and for supplying and treating ice making water and including a main pipe, said branch pipe being adapted to be detachably connected by means of a joint to said main pipe;

cover lids adapted to cover said ice cans;

an ice stripping-off area provided with means for stripping-off ice blocks formed within said ice cans;

a pair of rails extending between said ice-making area and said ice stripping-off area;

an overhead travelling crane comprising a trolley adapted to travel on said rails;

at least two pairs of guide rods suspended from said trolley;

at least one hook device adapted to be lifted up or lowered down while being guided by said guide rods to permit said crane to lift up and transfer said ice cans together with said cover lid by upwardly engaging with said lugs;

a plurality of sub-branch pipes branched and suspended from said branch pipe toward the lower center of each said ice can for supplying water and for exchanging core water in said ice cans;

said main pipe, branch pipe, and sub-branch pipes being adapted to supply ice making water to and to exchange core water in said ice cans;

said joint connecting said main pipe to said branch pipe is disposed at a position away from said ice cans;

a stop valve provided in said main pipe on the upstream side of said joint; and water piping for exchanging core water, said piping being provided between said joint and said stop valve via additional stop valves operatively associated exclusively with said water piping.

22. Ice making equipment according to claim 21, wherein:

a filtration tank is provided in said water piping for exchanging core water.

23. Ice making equipment according to claim 21, wherein:

said water piping for exchanging core water comprises in series a core water suction pump, a filtration tank, and a water discharge pump.

24. Ice making equipment according to claim 21, wherein:

said plurality of ice cans are gathered in a group to comprise a can grid; and said joint is disposed away from said can grid.

25. Ice making equipment according to claim 1, wherein said means for supplying and treating ice making water comprises means for agitating water in said ice cans, said means for agitating water including:

a reciprocally-acting link device connected to a driving means;

a branch shaft actuating device operatively associated with said driving means;

an agitating plate suspended from said branch shaft into each ice can;

means for connecting and disconnecting said agitating means; and said actuating means further comprising a ring provided at said reciprocally-acting link and a part of said branch shaft bent downwardly normal to the axis of said branch shaft.

* * * * *